US007595716B2

(12) United States Patent
Goto et al.

(10) Patent No.: US 7,595,716 B2
(45) Date of Patent: Sep. 29, 2009

(54) ELECTRONIC COMPONENT AND METHOD FOR MANUFACTURING THE SAME

(75) Inventors: Seiji Goto, Yasu (JP); Masahiro Kimura, Ogaki (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/185,399

(22) Filed: Aug. 4, 2008

(65) Prior Publication Data

US 2009/0040009 A1 Feb. 12, 2009

Related U.S. Application Data

(63) Continuation of application No. PCT/JP2007/015735, filed on Feb. 1, 2007.

(30) Foreign Application Priority Data

Feb. 3, 2006 (JP) ..... 2006-027594

(51) Int. Cl.
*H01C 1/012* (2006.01)

(52) U.S. Cl. ..... 338/307; 338/213; 338/333

(58) Field of Classification Search ..... 338/307–309, 338/115, 132, 204, 213, 333
See application file for complete search history.

(56) References Cited

U.S. PATENT DOCUMENTS 3,974,105 A * 8/1976 Sato et al. ..... 252/512
5,285,049 A * 2/1994 Fukumoto et al. ..... 219/216
5,640,137 A * 6/1997 Mantha ..... 338/308
6,114,645 A * 9/2000 Burgess ..... 200/512

FOREIGN PATENT DOCUMENTS

| | | |
|---|---|---|
| JP | 59-215763 | 12/1984 |
| JP | 60-30101 | 2/1985 |
| JP | 2-52406 | 2/1990 |
| JP | 6-275934 | 9/1994 |
| JP | 10-189305 | 7/1998 |
| JP | 2004-165201 | 6/2004 |

OTHER PUBLICATIONS

International Search Report.
Written Opinion with English language translation.

* cited by examiner

*Primary Examiner*—Kyung Lee
(74) *Attorney, Agent, or Firm*—Keating & Bennett, LLP

(57) ABSTRACT

To provide an electronic component including a resistor element that can be efficiently produced with a range of resistances, and a method for manufacturing the electronic component, the electronic component includes a pair of terminals, and a resistor element disposed between the terminals. The resistor element includes at least two resistive portions (hereinafter referred to as a first resistive portion and a second resistive portion) that are continuously disposed. The first resistive portion includes a plurality of first dots overlapping one another. The second resistive portion includes a plurality of second dots having a different electric resistance from that of the first dots overlapping one another.

12 Claims, 5 Drawing Sheets

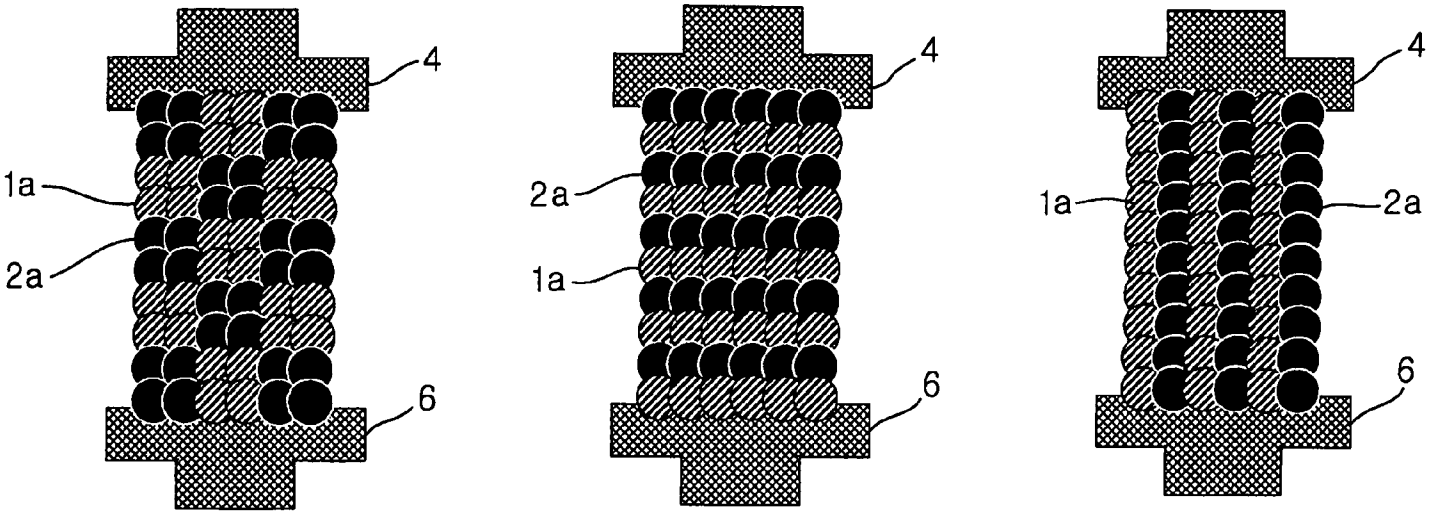
Fig. 2(a)
Fig. 2(b)
Fig. 2(c)
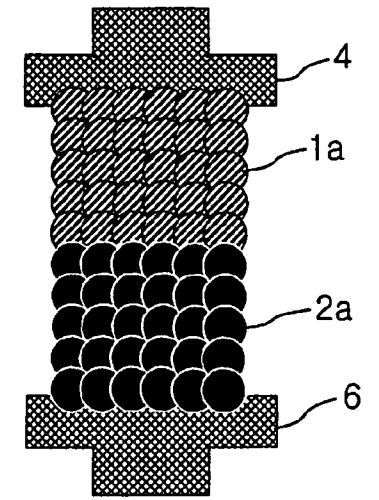
Fig. 2(d)
Fig. 2(e)
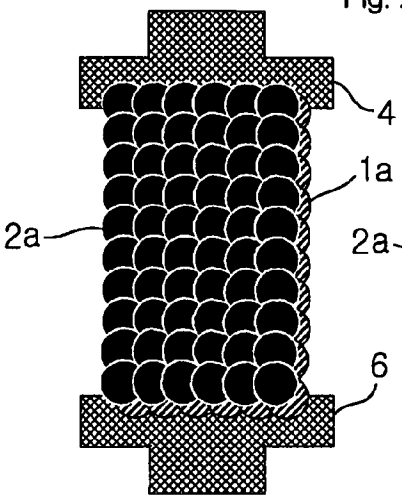
Fig. 2(f)
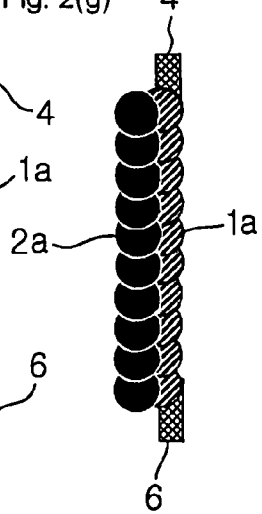
Fig. 2(g)

ELECTRONIC COMPONENT AND METHOD FOR MANUFACTURING THE SAME

CROSS-REFERENCE TO RELATED APPLICATIONS

This is a continuation under 35 U.S.C. § 111 (a) of PCT/JP2007/051735 filed Feb. 1, 2007, and claims priority of JP2006-027594 filed Feb. 3, 2006, both incorporated by reference.

BACKGROUND

1. Technical Field

The present disclosure relates to electronic components and methods for manufacturing the same. More specifically, the invention relates to an electronic component having a resistor element and a method for manufacturing the same.

2. Background Art

Screen printing, an ink jet method, and other methods are known as techniques for forming a resistor element, such as a resistive film having a desired resistance, for a resistor or the like.

For example, Patent Document 1 discloses that a substantially band-like first resistive portion defined by dots having different areas disposed at different intervals and a second resistive portion having a different electric resistance from the first resistive portion are continuously formed in that order on the surface of a base material by screen printing.

Patent Document 2 discloses that a single type of resistive ink is applied onto a ceramic green sheet by an ink jet method to form a resistor.

Patent Document 1: Japanese Unexamined Patent Application Publication No. 60-30101

Patent Document 2: Japanese Unexamined Patent Application Publication No. 10-189305

When resistive portions are formed by screen printing as in Patent Document 1, however, the screen plate must be replaced for every change in resistance. Accordingly, a high cost is required for preparing a corresponding screen plate for each resistance and it takes a long time to prepare the screen plates.

When at least two types of electroconductive pastes are printed by screen printing, they cannot be printed at one time. For each electroconductive paste, several steps are required including printing, drying, and replacing the screen plate. In addition, the second and subsequent printings of electroconductive pastes require precise positioning with respect to the previously printed electroconductive paste. Furthermore, electroconductive pastes applied by the second and subsequent screen printing do not sufficiently fill the spaces between the previously printed electroconductive pastes, and gaps may be formed. It is thus difficult to simplify the process.

When a resistor is produced using a single type of resistive ink as in Patent Document 2, resistive inks having different compositions according to desired resistances must be prepared in order to form resistors with the same size and shape having different resistances. This is not suitable for small-volume production in great varieties.

SUMMARY

Accordingly, the present disclosure provides an electronic component including a resistor element can be efficiently produced with a range of resistances, and a method for manufacturing the electronic component.

An embodiment of the electronic component includes a pair of terminals opposing each other and a resistor element disposed between the pair of terminals. The resistor element includes at least two resistive portions (hereinafter referred to as first resistive portion and second resistive portion) that are continuously disposed. The first resistive portion includes a plurality of first dots overlapping one another, and the second resistive portion includes a plurality of second dots having a different electric resistance from the first dots overlapping one another.

In this structure, the first dots and the second dots are formed by ejecting fine particles of resistive inks having different compositions to apply the resistive inks onto a base material by, for example, an ink jet method. Alternatively, a laser printer may be used to apply fine particles of resistive toners having different compositions to the base material. The resistor element includes at least two portions: a first resistive portion and a second resistive portion, and the resistive portions each contain a plurality of dots overlapping each other.

The above structure does not require screen plates in a manufacture of the resistor element. Hence, costs for preparing and maintaining screen plates are eliminated. Since the plate making time is eliminated, the delivery time can be shortened. By varying the size or number of dots in the resistive portions, or the shape of the resistive portions, the resulting resistor element can have a variety of resistance without changing the resistive inks or resistive toners for forming dots.

In one embodiment, the first resistive portion and the second resistive portion are arranged in series between the terminals.

In this structure, a desired resistance can easily be calculated. Also, the resistance of a resistor element that has been completed can be adjusted later. For adjusting the resistance later, the resistive portion having a higher resistance may be partially removed to roughly adjust the resistance, and then the resistive portion having a lower resistance is partially removed to finely adjust the resistance.

In another embodiment, the first resistive portion and the second resistive portion are arranged in parallel between the terminals. In this instance, the first resistive portion and the second resistive portion may be in contact with each other or separate from each other. When they are in contact with each other, they may be disposed one on top of the other. When they are disposed one on top of the other, the second resistive portion may be disposed in an island manner on the first resistive portion.

In such a structure, a desired resistance can easily be calculated. Also, the resistance of a resistor element that has been completed can be adjusted later. For adjusting the resistance later, the resistive portion having a higher resistance may be partially removed to roughly adjust the resistance, and then the resistive portion having a lower resistance is partially removed to finely adjust the resistance.

At least one of the first resistive portion and the second resistive portion may advantageously be made of a metal.

Examples of the metal include various types, such as Ni—Cr having a quite high resistance, Pd having a rather high resistance, and Ag having a low resistance. The resistor element can have a range of resistance according to the intended application.

In order to solve the above-described problems, the following first method is provided for manufacturing an electronic component.

The method for manufacturing an electronic component includes: (1) the first step of applying a first resistive ink containing a constituent of one part of a resistor element to a first region of a base material by an ink jet method so as to dispose a plurality of first dots overlapping one another; (2) the second step of applying a second resistive ink to a second region adjacent to the first region of the base material so as to dispose a plurality of second dots overlapping one another, the second resistive ink having a different composition from the first resistive ink and containing a constituent of the other part of the resistor element; (3) the third step of heating the first dots in the first region and the second dots in the second region to yield the resistor element.

In the method, the first dots and the second dots are formed by respectively ejecting fine ink droplets of the first resistive ink and the second resistive ink onto a base material. The resistor element is divided into at least two regions: a first region and a second region. Each region includes a plurality of dots overlapping one another. The second step may be started before the completion of the first step. The third step may include a plurality of sub steps performed at different temperatures for drying and firing. The drying step may be started before completion of the first step or the second step.

The method can eliminate the necessity of screen plates, costs for preparing and maintaining screen plates, and screen plate-making time, for forming a resistor element. By varying the size or number of dots in a region using the same resistive ink, or the shape of the region, a resistor element having a variety of resistance can be formed.

Preferably, the method further includes the dot drying step of drying the first dots before the second step. The dot drying step may be performed independently between the first step and the second step, but preferably performed simultaneously with the first step. For example, the base material may be heated to a temperature higher than room temperature in the first step, or the first step is performed in a drying atmosphere. Preferably, the dot drying step is thus performed.

By heating the base material to a temperature higher than room temperature (for example, 25° C. or more), or by performing the first step in a drying atmosphere, the drying time of the first dots disposed on the base material can be shortened. Accordingly, even though two resistive inks are superposed or horizontally arranged, the two inks are not easily mixed, and thus a desired resistance can be produced.

The following second method is also provided for manufacturing an electronic component.

The method for manufacturing an electronic component includes: (1) the first step of applying a first resistive ink containing a constituent of a resistor element to a base material by an ink jet method so as to dispose a plurality of first dots; (2) a second step of applying a second resistive ink by an ink jet method so as to dispose a plurality of second dots on the first dots to mix the first resistive ink of the first dots with the second resistive ink of the second dots, thus forming a mixed portion, the second resistive ink containing a constituent of the resistor element and having a different composition from the first resistive ink; and (3) the third step of heating the mixed portion to yield the resistor element.

The second step may be started before completion of the first step.

The method can eliminate the necessity of screen plates, costs for preparing and maintaining screen plates, and screen plate-making time, for forming a resistor element. A variety of resistance can be obtained by varying the mixing ratio of resistive inks, the size (amount of ink) or number of the first or second dots, or the number of times of printing.

Preferably, the first step and the second step are performed at a temperature lower than or equal to room temperature.

By cooling the base material to a temperature lower than or equal to room temperature (for example, lower than 25° C.), the drying of the ink of the first dots is delayed so that the mixing time of the ink can be increased. Consequently, the variation in resistance of the resulting resistive film can be reduced, and, thus a stable resistance can be produced.

According to the present invention, a resistor element having a variety of resistance can be efficiently produced.

Other features and advantages will become apparent from the following description of embodiments, which refers to the accompanying drawings.

BRIEF DESCRIPTION OF DRAWINGS

FIG. 2 is a schematic representation of printing patterns (Embodiment 1).

DETAILED DESCRIPTION

Reference Numerals

Figure 1:
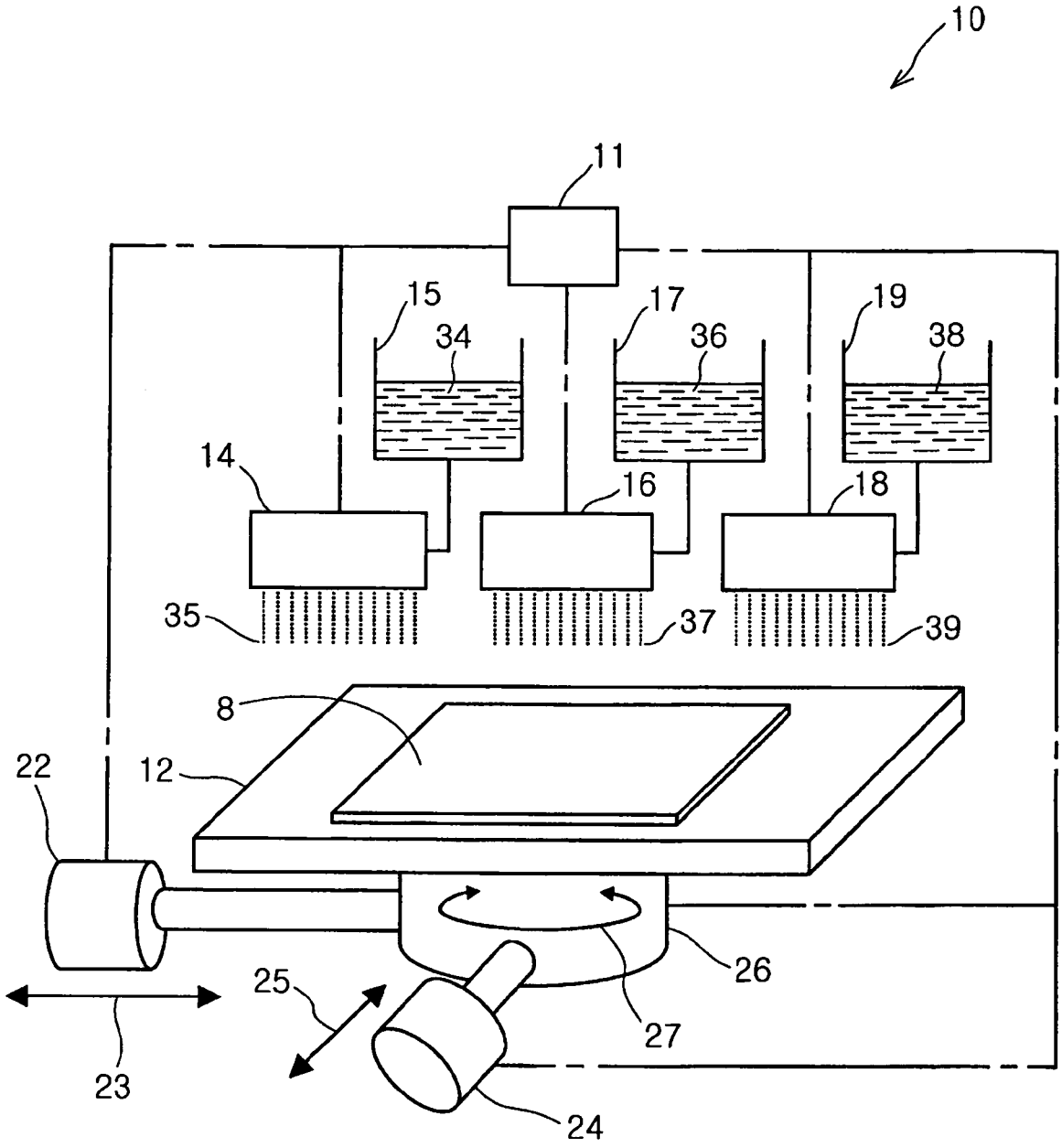
FIG. 1 is a general view of the structure of an ink jet printer used for printing (Embodiment 1).

1*a* first dot
2*a* second dot
3 mixing portion
4 terminal
6 terminal
8 base material
10 ink jet printer
14, 16, 18 ink jet head
34, 36, 38 resistive ink
35, 37, 39 ink droplet Embodiments of the present invention will now be described with reference to FIGS. 1 to 5.

Embodiment 1

Embodiment 1 will now be described with reference to FIGS. 1 to 3.

An ink jet printer 10 used for printing a pattern intended for a resistive film (resistor element) will first be described with reference to the schematic representation shown in FIG. 1.

The ink jet printer 10 generally includes a movable table 12 on which a base material 8 is placed, a plurality of (for example, three) ink jet heads 14, 16, and 18, and a controller 11 controlling the entire apparatus.

The movable table 12 is driven in the X direction designated by reference numeral 23 by a motor 22, in the Y direction designated by reference numeral 25 by another motor 24, and in the θ direction designated by reference numeral 27 (around on the Z axis perpendicular to the x and the y axis) by still another motor 26. The drive of the movable table 12 by the motors 22, 24, and 26 is controlled by the controller 11. The movable table 12 may be able to move in a direction other than the X, Y, and θ directions, or only in one or two directions of the X, Y, and θ directions. The movable table 12 may have a vacuum suction hole for securing the base material 8 by suction, and/or a heater for heating the base material 2, if necessary.

The ink jet heads 14, 16, and 18 are each fixed above the movable table 12. Resistive inks 34, 36, and 38 having different compositions are fed to the ink jet heads 14, 16, and 18 from tanks 15, 17, and 19, respectively. The ink jet heads 14, 16, and 18 each have at least one tiny hole through which ink droplets 35, 37, or 39 being the particles of the corresponding resistive ink 34, 36, or 38 are ejected onto the movable table 12. The size and number of the ink droplets 35, 37,39 ejected from the ink jet heads 14, 16, and 18 are carried by the control of the controller 11.

The resistive inks 34, 36, and 38 each contain a resistive material, such as ruthenium oxide, glass, carbon, or metal particles. The resistive materials contained in the resistive inks 34, 36, and 38 can be selected according to the desired resistance. For example, metal particles include various types, such as Ni—Cr having a quite high resistance, Pd having a rather high resistance, and Ag having a low resistance. Any type may be used according to the application. The base material 8 disposed on the movable table 12 is a work piece, such as a substrate or a ceramic green sheet, on which an electronic component will be produced.

The controller 11 can be, for example, a personal computer. The controller 11 operates the ink jet heads 14, 16, and 18 to eject the ink droplets 35, 37, and 39 in synchronization with the movement of the movable table 12 according to parameters input through a key board or the like (not shown) and a specific program. Consequently, a predetermined pattern is printed with the resistive inks 34, 36, and 38 on the base material 8 disposed on the movable table 12.

Preferably, the ink jet heads 14, 16, and 18 each have a plurality of holes aligned in a line through which the respective ink droplets 35, 37, and 39 are ejected, and the ink jet heads 14, 16, and 18 are arranged in such a manner that the lines of the holes of the respective heads are disposed in parallel with each other. The movable table 12 moves in the direction in which the ink jet heads 14, 16, and 18 are disposed (in the direction perpendicular to the hole lines) or in a slanting direction. Thus, the resistive inks 34, 36, and 38 are printed substantially simultaneously to form a pattern intended for the resistor elements.

Instead of fixed ink jet heads 14, 16, and 18 and the movable base material 8, the base material 8 may be fixed using movable ink jet heads 14, 16, and 18, or both the base material 8 and the ink jet heads 14, 16, and 18 may be movable.

The pattern intended for the resistive film printed with the plurality of resistive inks by the ink jet printer 10 is then dried and fired. Thus, the resistive film is completed.

For a pattern intended for the resistive film, for example, the base material is divided into a plurality of printing areas (regions) along the surface of the base material, and the printing areas are coated with different types of resistive inks with a plurality of ink jet heads. Thus, the resistive film can have a different resistance from a resistive film formed of a single type of resistive ink. Also, a resistive film having another resistance can be formed by changing the plane or sectional shape of the pattern intended for the resistive film.

Preferably, the base material 8 is heated to higher than room temperature (for example, 25° C. or more) during printing, or the printing is performed in a drying atmosphere, such as of dry air. For example, the movable table 12 has a heater to heat the base material 8. The substrate 8 may be heated before printing, or may be heated to a temperature higher than room temperature under controlled air conditions during printing. The printing section may be enclosed with a cover, and dry air with a predetermined humidity is delivered into the enclosure to maintain a drying atmosphere. Thus, the dots of the resistive inks printed on the base material 8 can be more quickly dried. Consequently, two resistive inks are not mixed even if they are overlapped or horizontally applied, thus easily providing a desired resistance.

The pattern intended for a resistive film can be printed as illustrated in the schematic representations shown in FIGS. 2(*a*)-(*g*) and 3(*a*)-(*c*). Dots 1*a* and 2*a* of two resistive inks 1 and 2 are disposed between terminals 4 and 6 previously formed on the base material 8 (see FIG. 1). Groups of dots 1*a* and 2*a* form the pattern intended for the resistive film.

The pattern shown in the plan view of FIG. 2(*a*) includes first groups and second groups between the terminals 4 and 6. Each first group is defined by a plurality of dots 1*a* (2 by 2 in the figure) of resistive ink 1, and each second group is defined by a plurality of dots 2*a* (2 by 2 in the figure) of resistive ink 2. The first groups and the second groups are alternately arranged in a staggered manner. The two types of dots 1*a* and 2*a* overlap each other, and thus the first groups and the second groups are continuous.

The pattern shown in the plan view of FIG. 2(*b*) includes first groups and second groups between terminals 4 and 6. Each first group is defined by a plurality of dots 1*a* (six in the figure) of resistive ink 1 arranged perpendicular to the direction connecting the terminals 4 and 6, each second group is defined by a plurality of dots 2*a* (six in the figure) of resistive ink 2 arranged perpendicular to the direction connecting the terminals 4 and 6. The first groups and the second groups are alternately arranged in the direction perpendicular to the direction connecting the terminals 4 and 6. The two types of dots 1*a* and 2*a* overlap each other, and thus the first groups and the second groups are continuous.

The pattern shown in the plan view of FIG. 2(*c*) includes first groups and second groups between terminals 4 and 6. Each first group is defined by a plurality of dots 1*a* (ten in the figure) of resistive ink 1 arranged along the direction connecting the terminals 4 and 6, and each second group is defined by a plurality of dots 2*a* (ten in the figure) of resistive ink 2 arranged along the direction connecting the terminals 4 and 6. The first groups and the second groups are alternately arranged perpendicular to the direction connecting the terminals 4 and 6. The two types of dots 1*a* and 2*a* overlap each other, and thus the first groups and the second groups are continuous.

The pattern shown in the plan view of FIG. 2(*d*) includes a first group and a second group between terminals 4 and 6. The first group is defined by a plurality of dots 1*a* (5 by 6 in the figure) of resistive ink 1 arranged in a rectangular manner, and the second group is defined by a plurality of dots 2*a* (5 by 6 in the figure) of resistive ink 2 arranged in a rectangular manner. The first group and the second group are disposed in series between the terminals 4 and 6. The two types of dots 1*a* and 2*a* overlap each other, and thus the first group and the second group are continuous.

The pattern shown in the plan view of FIG. 2(*e*) includes a first group and a second group between terminals 4 and 6. The first groups is defined by a plurality of dots 1*a* (10 by 3 in the figure) of resistive ink 1 arranged in a rectangular manner, and the second group is defined by a plurality of dots 2*a* (10 by 3 in the figure) of resistive ink 2 arranged in a rectangular manner. The first group and the second group are disposed in parallel. The two types of dots 1*a* and 2*a* overlap each other and thus the first group and the second group are continuous.

When the first group and the second group are disposed in parallel, they may be partially in parallel. For example, part of the first group defined by the dots 1*a* of resistive ink 1 and part of the second group defined by the dots 2*a* of resistive ink 2 may be disposed one on top of the other, as shown in FIG. 3(*a*), or the entire second group defined by the dots 2*a* of resistive ink 2 is disposed in an island manner on part of the first group defined by the dots 1*a* of resistive ink 1, as shown in FIG. 3(*b*). In these cases, the vertical positions of the first group and the second group may be inverted. The first group defined by the dots 1*a* of resistive ink 1 and the second group defined by the dots 2*a* of resistive ink 2 may be separate, as shown in FIG. 3(*c*).

The pattern shown in the plan view of FIG. 2(*f*) and the side view of FIG. 2(*g*) includes a first group as a first layer and a second group as a second layer between terminals 4 and 6. The first group is defined by a plurality of dots 1*a* (10 by 6 in the figure) of resistive ink 1 arranged in a rectangular manner, and the second group is defined by a plurality of dots 2*a* (10 by 6 in the figure) of resistive ink 2 arrange in a rectangular manner. The two types of dots 1*a* and 2*a* are disposed one on top of the other, and thus the first group and the second group are continuous.

In each of the patterns shown in FIGS. 2(*a*)-(*g*) and 3(*a*)-(*c*), the dots 1*a* of the first group are disposed in a first region and the dots 2*a* of the second group are disposed in a second region. The first group including dots 1*a* and the second group including dots 2*a* are dried and fired to form the resistive film and act as a first resistive portion and a second resistive portion, respectively.

In the pattern shown in FIG. 2(*a*), preferably, the first group of resistive ink 1 and the second group of resistive ink 2 are formed rather large so that the overlaps of resistive inks 1 and 2 (boundaries between the first regions in which the first dots 1*a* are disposed and the second regions in which the second dots 2*a* are disposed), which may result in variation in resistance, are shortened as a whole. Thus, the resistances of the resistive film between the terminals 4 and 6 can easily be estimated. Also, the electric resistance can be uniformly distributed between the terminals 4 and 6.

Figures 3A, 3B, 3C:
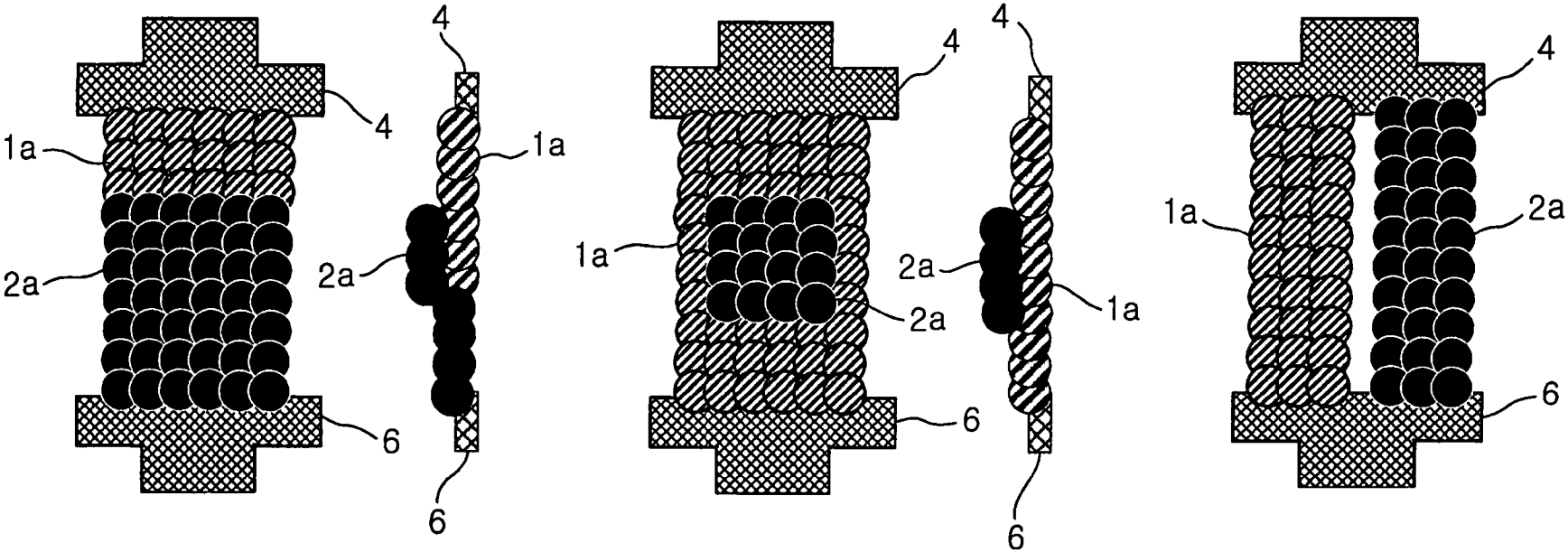
FIG. 3 is a schematic representation of printing patterns (Embodiment 1).

In the patterns shown in FIGS. 2(*b*) to 2(*g*) and FIG. 3, the first groups of resistive ink 1 and the second groups of resistive ink 2 are arranged in series or parallel between the terminals 4 and 6. The resistances of the resistive film between the terminals 4 and 6 can easily be estimated. In order to adjust the resistance of the resulting resistive film, for example, the group having a higher resistance is partially removed to roughly adjust the resistance and then the group having a lower resistance is partially removed to finely adjust the resistance.

The resistance of the resistive film between the terminals 4 and 6 can be varied by changing the pattern formed by applying resistive inks 1 and 2 (sizes, shapes, and arrangements of the groups), and the size (amount of ink droplet) or number of the dots 1*a* or 2*a* of resistive inks 1 or 2 of each group.

The use of a plurality of ink jet heads allows at least two resistive inks to be printed at one time. Consequently, drying can be completed by only one step. In addition, printing can be performed at one time without interruption by a drying step. Thus, the resistive inks can easily be printed with highly precise alignment without aligning printing positions.

Also, since screen plates are not used, the second or a subsequent resistive ink can be printed in a pattern without forming gaps even if the first resistive ink has been printed with narrow intervals.

Furthermore, the resistance depending on how the plurality of resistive inks are applied can easily be varied or adjusted by changing parameters of software.

Specific examples will now be described.

Two ink jet resistive inks 1 and 2 having different compositions were prepared in advance in which materials of a resistive film for an electronic component, such as ruthenium oxide ($RuO_2$) and glass, are dispersed in an organic solvent.

The solid of resistive ink 1 contained 30% by weight of $RuO_2$, 56% by weight of $CaO—Al_2O_3—SiO_2—B_2O_3$ glass, 14% by weight of $SiO_2—B_2O_3—K_2O$ glass. The solid of resistive ink 2 contained 50% by weight of $RuO_2$, 35% by weight of $CaO—Al_2O_3—SiO_2—B_2O_3$, 15% by weight of $SiO_2—B_2O_3—K_2O$ glass. Resistive ink 1 had a viscosity of 89 mPa·s at room temperature, and resistive ink 2 had a viscosity of 109 mPa·s at room temperature. Since the inks were heated before being ejected, however, the viscosities before ejection were reduced to lower than those at room temperature, and to about 20 mPa·s.

An ink jet printer and a ceramic green sheet were prepared. The ink jet printer had a movable table 2 that can move in the X direction and the Y direction under two piezoelectric ink jet heads. The ceramic green sheet is provided with two separate silver electrodes as a pair of terminals. Each ink jet head had 256 holes of 50 μm in diameter aligned in a line at intervals of 280 μm, and ejected ink droplets of 10 to 100 pL (picoliters) each.

Resistive inks 1 and 2 were substantially simultaneously ejected from the two respective ink jet heads of the ink jet printer onto the ceramic green sheet to print a pattern as shown in the schematic view of FIG. 2(*a*). Specifically, a rectangular pattern was printed between the silver electrodes such that first groups each defined by a plurality of dots of resistive ink 1 and second groups each defined by a plurality of dots of resistive ink 2 were alternately arranged in a staggered manner.

The printed ceramic green sheet and another sheet were laminated, pressed, and fired to yield a ceramic substrate including a resistive film between the silver electrodes. The resistance of the resistive film on the ceramic substrate was measured and the result was 5.4 kΩ.

For Comparative Example 1, only resistive ink 1 was ejected to print a rectangular pattern connecting two silver electrodes on a ceramic green sheet. The printed ceramic green sheet and another sheet were lamented, pressed, and fired in the same manner as in Example 1 to yield a ceramic substrate including a resistive film made of only resistive ink 1 between the silver electrodes. The resistance of the resistive film made of only resistive ink 1 was measured and the result was 84 kΩ.

For Comparative Example 2, only resistive ink 2 was ejected to print a rectangular pattern connecting two silver electrode on a ceramic green sheet. The printed ceramic green sheet and another sheet were laminated, pressed, and fired in the same manner as in Example 1 to yield a ceramic substrate including a resistive film made of only resistive ink 2 between the silver electrodes. The resistance of the resistive film made of only resistive ink 2 was measured and the result was 2.3 kΩ.

As is clear from the above specific examples, the resistive film formed by applying resistive ink 1 and resistive ink 2 can have a resistance between the resistances of the resistive film made of only resistive ink 1 and the resistive film made of only resistive ink 2.

Embodiment 2

Embodiment 2 will now be described with reference to FIGS. 4 and 5.

In Embodiment 2 as well, an ink jet printer is used for printing.

Figure 4:
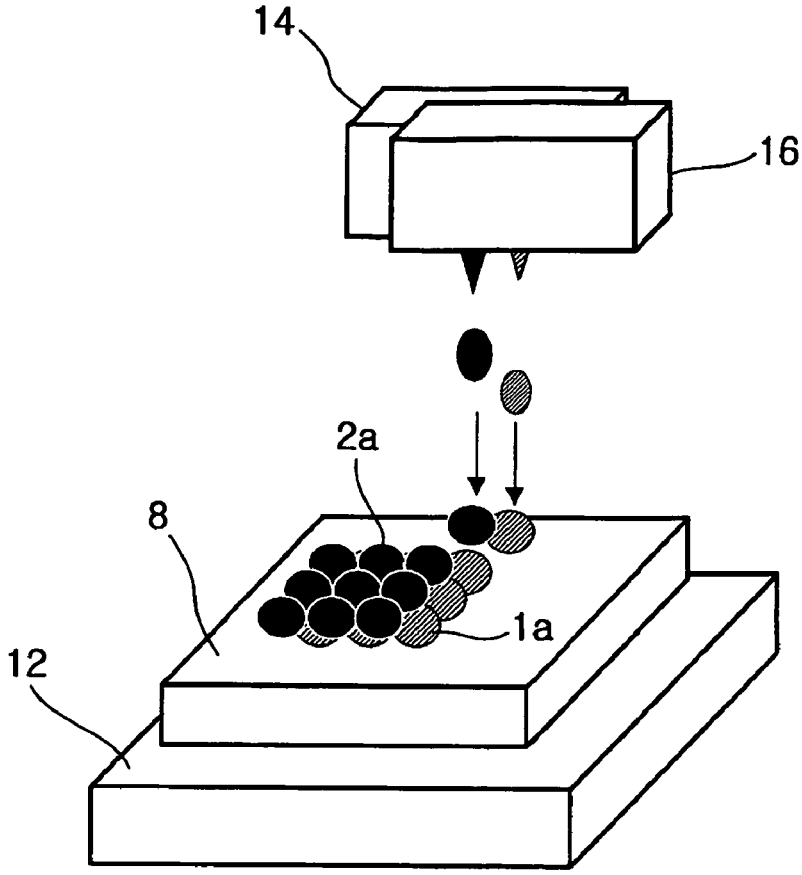
FIG. 4 is a schematic representation of a printing method (Embodiment 2).

As schematically shown in FIG. 4, resistive inks ejected from the respective ink jet heads 14 and 16 are simultaneously printed at substantially the same position on a base material 8 disposed on a movable table 12. In this instance, some or all of the dots 1*a* of resistive ink 1 ejected from the ink jet head 14 and some or all of the dots 2*a* of resistive ink 2 ejected from the ink jet head 16 are disposed one on top of the other. Also, the dots 2*a* of resistive ink 2 are disposed on the dots 1*a* of resistive ink 1 before the dots 1*a* are dried so that the dots 1*a* and 2*a* of resistive inks 1 and 2 are mixed. In order to accelerate the mixing, supersonic waves may be applied. Part of the constituents of resistive ink 1 and part of the constituents of resistive ink 2 may chemically react with each other or form an alloy by the mixing.

Preferably, the movable table 12 is cooled to a temperature lower than or equal to room temperature (for example, lower than 25° C.). Thus, the drying of the resistive inks is delayed so that the mixing time of the resistive inks can be increased. Consequently, the variation in resistance of the resulting resistive film can be reduced, and, thus a stable resistance can be produced.

Figure 5:
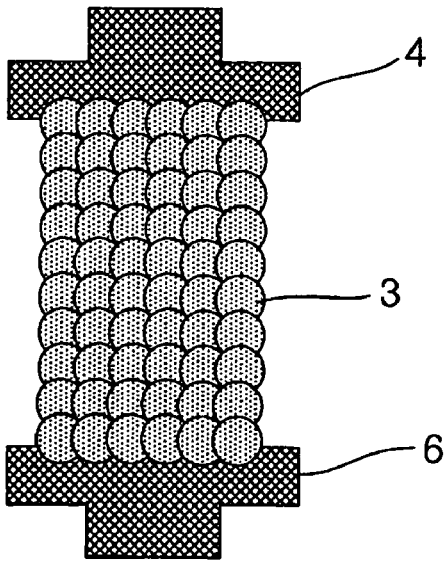
FIG. 5 is a schematic representation of a printed pattern (Embodiment 2)

By mixing the resistive inks, a mixed portion 3 in the resistive inks 1 and 2 are mixed is formed between the terminals 4 and 6, as schematically shown in the plan view of FIG. 5. The mixed portion 3 is dried and fired to yield a resistive film between the terminals 4 and 6.

The resistance of the resistive film between the terminals 4 and 6 can be varied, for example, by varying parameters of the program for the controller 11 to change the mixing ratio or the printed areas of the resistive inks 1 and 2, or the shape (plane shape, sectional shape) of the printed pattern. The mixing ratio of resistive inks 1 and 2 can be varied by changing the sizes (amount of ink dots) or the numbers of the dots 1*a* and 2*a* of resistive inks 1 and 2, or the number of times of superposing printing of the inks.

By printing dots 1*a* and 2*a* of resistive inks 1 and 2 at constant intervals with a constant mixing ratio maintained, a substantially uniform resistive film can be formed between the electrodes 4 and 6.

The mixing ratio of the resistive inks 1 and 2 for a resistive film having a desired electric resistance can be estimated according to a law called "volume mixing law" (following equation (1)).

More specifically, in the resistivity or the dielectric constant of a composite material prepared by mixing a plurality of, for example, two constituents, the following approximate equation holds:

$$V_{total} \log \rho_{total} = V_1 \log \rho_1 + V_2 \log \rho_2 \quad (1)$$

In the equation, $V_{total}$ represents the volume of the composite material, $\rho_{total}$ represents the resistivity of the composite material. $V_1$ and $V_2$ represent the volumes of constituents 1 and 2, respectively, in the composite material. ρ1 and ρ2 represent the resistivities of constituents 1 and 2.

Specific examples will now be described.

In the same manner as in Example 1, resistive inks 1 and 2 were ejected to be printed by an ink jet printer so that a plurality of dots of resistive inks 1 and 2 were superimposed, and were thus formed into a pattern intended for a resistive film while the resistive inks 1 and 2 were mixed on the ceramic green sheet. In this instance, the movable table was not heated and was kept room temperature (25° C.) to delay the drying of the inks on the ceramic green sheet, thus ensuring a sufficient time to mix resistive inks 1 and 2.

The green sheet on which a pattern intended for the resistive film had been printed and another sheet were laminated, pressed, and fired to yield a resistive film. The resistance of the resistive film was measured and the result was 15.3 kΩ. This resistance was between the resistances of the resistive film made of only resistive ink 1 of Comparative Example 1 and the resistive film made of only resistive ink 2 of Comparative Example 2.

Embodiment 3

Embodiment 3 will now be described with reference to FIG. 6.

Figure 6A:
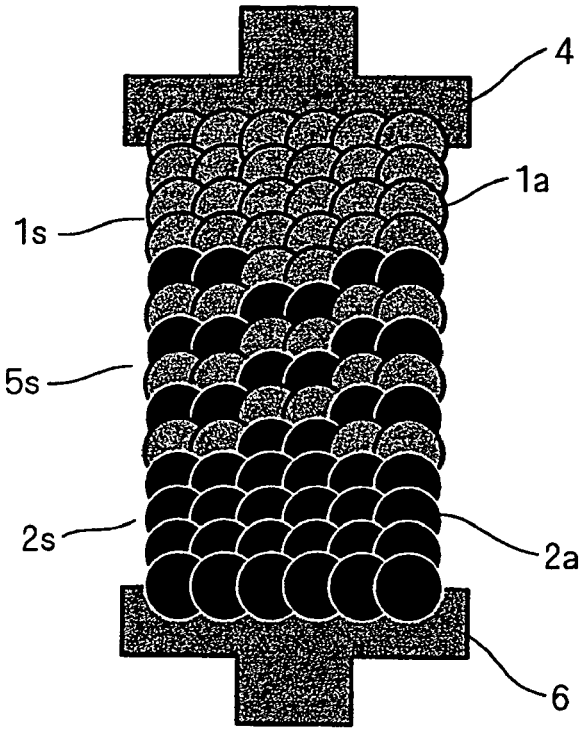
FIG. 6 is a schematic representation of printed patterns (Embodiment 3)
Figure 6B:
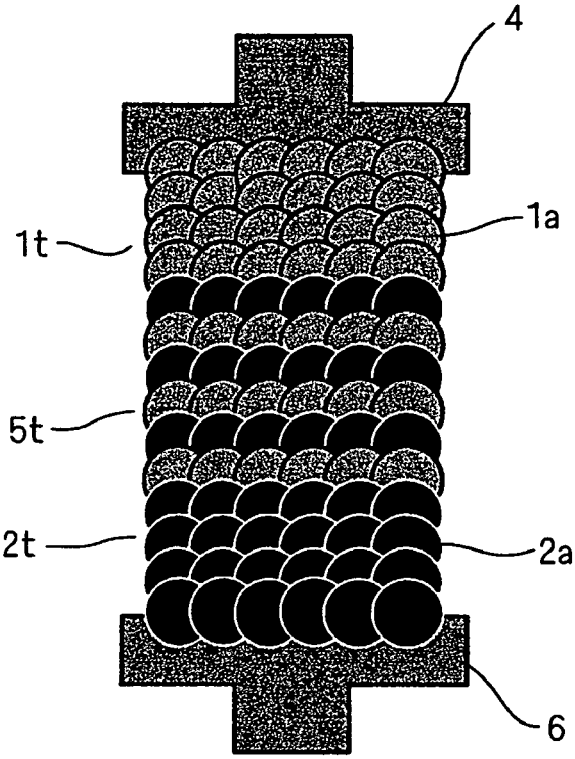

The pattern shown in the plan view of FIG. 6(*a*) includes first groups disposed at the terminal 4 side and second groups disposed at the terminal 6 side, like the pattern shown in FIG. 2(*d*). The first group 1*s* is defined by a plurality of (4 by 6 in the figure) dots 1*a* of resistive ink 1 arranged in a rectangular manner, and the second group 2*s* is defined by a plurality of (4 by 6 in the figure) dots 2*a* of resistive ink 2 arranged in a rectangular manner. Third groups and fourth groups are disposed in a staggered manner like the pattern shown in FIG. 2(*a*) in a region 5*s* between the first group 1*s* and the second group 2*s*. Each third group is defined by a plurality of dots 1*a* of resistive ink 1 as in the pattern shown in FIG. 2(*a*), and each fourth group is defined by a plurality of dots 2*a* of resistive ink 2. The dots 1*a* and 2*a* overlap each other and thus the first to the fourth group are continuous.

The pattern shown in the plan view of FIG. 6(*b*) includes a first group 1*t* disposed at the terminal 4 side and a second group 2*t* disposed at the terminal 6 side, like the pattern shown in FIG. 2(*d*). The first group 1*t* is defined by a plurality of (4 by 6 in the figure) dots 1*a* of resistive ink 1 arranged in a rectangular manner, and the second group 2*t* is defined by a plurality of (4 by 6 in the figure) dots 2*a* of resistive ink 2 arranged in a rectangular manner. Third groups and fourth groups are disposed in a region 5*t* between the first group 1*t* and the second group 2*t*. Each third group is defined by a plurality of (6 in the figure) dots 1*a* of resistive ink 1 arranged in a line perpendicular to the direction connecting the terminals 4 and 6. Each fourth group is defined by a plurality of (6 in the figure) dots 2*a* of resistive ink 2 arranged in a line perpendicular to the direction connecting the terminals 4 and 6. The third groups and the fourth groups are alternately arranged in the direction connecting the terminals 4 and 6. The dots 1*a* and 2*a* overlap each other, and thus the first to the fourth group are continuous.

By arranging the dots 1*a* and 2*a* having different resistances as shown in FIGS. 6(*a*) and 6(*b*), a resistance gradient is produced between the terminals 4 and 6. For example, a pattern formed with dots 1*a* of resistive ink 1 containing Pd having a higher electric resistance and dots 2*a* of resistive ink 2 containing Ag having a lower electric resistance has electric resistances gradually decreasing in the direction from the terminal 4, at the upper side in the figure, to the lower terminal 6, thus having a resistance gradient.

By providing a resistance gradient, impedance matching can be achieved between the circuit side and the ground side without additionally using a so-called shunt resistor. Thus, an effect of grounding can be produced by a simple method.

Both of the dots 1*a* of resistive ink 1 and the dots 2*a* of resistive ink 2 may be made of metals, or at least one of the resistive inks 1 and 2 may be made of a metal and the other may be made of a non-metal, such as ruthenium oxide, glass, or carbon. Such a non-metal can provide a resistance gradient between the terminals 4 and 6.

CONCLUSION

According to Embodiments 1 and 2, resistor elements having various resistances can efficiently be produced.

Printing resistive inks by an ink jet method eliminates the necessity of many screen plates and reduces the plate-making cost. Accordingly, electronic components can be manufactured at low cost. Since the plate-making time is eliminated, the delivery time can be shortened.

The ink jet method facilitates the change of the printed pattern. By changing the plane shape or the sectional shape of the pattern intended for the resistive film, a resistive film having a variety of resistance can easily be formed.

The invention is not limited to the above-described embodiments, and various modifications may be made.

For example, at least three types of resistive inks may be used. Or, as an alternative to an ink jet method, a laser printer may apply a plurality of dots having different electric resistances to produce a resistor element.

Although particular embodiments have been described, many other variations and modifications and other uses will become apparent to those skilled in the art. Therefore, the present invention is not limited by the specific disclosure herein.

What is claimed is:

1. An electronic component comprising:

a pair of terminals opposing each other; and a resistor element disposed between the pair of terminals, the resistor element including at least first and second resistive portions that are continuously disposed, wherein the first resistive portion includes a plurality of first dots overlapping one another, and the second resistive portion includes a plurality of second dots having a different electric resistance from that of the first dots overlapping one another.

2. The electronic component according to claim 1, wherein the first resistive portion and the second resistive portion are arranged in series between the terminals.

3. The electronic component according to claim 1, wherein the first resistive portion and the second resistive portion are arranged in parallel between the terminals.

4. The electronic component according to claim 1, wherein at least one of the first resistive portion and the second resistive portion contains a metal.

5. The electronic component according to claim 1, wherein the first resistive portion and the second resistive portion are arranged both in series and in parallel between the terminals.

6. A method for manufacturing an electronic component, comprising;

a first step of applying a first resistive ink containing a constituent of one part of a resistor element to a first region of a base material by an ink jet method so as to dispose a plurality of first dots overlapping one another;

a second step of applying a second resistive ink to a second region adjacent to the first region of the base material so as to dispose a plurality of second dots one on top of another, the second resistive ink having a different composition from the first resistive ink and containing a constituent of another part of the resistor element; and a third step of heating the first dots in the first region and the second dots in the second region to yield the resistor element.

7. The method for manufacturing an electronic component according to claim 6, further comprising a step of drying the first dots before the second step.

8. The method for manufacturing an electronic component according to claim 7, wherein the dot drying step dries the first dots by heating the base material in the first step.

9. The method for manufacturing an electronic component according to claim 8, wherein the dot drying step dries the first dots by performing the first step in a drying atmosphere.

10. The method for manufacturing an electronic component according to claim 7, wherein the dot drying step dries the first dots by performing the first step in a drying atmosphere.

11. A method for manufacturing an electronic component, comprising:

a first step of applying a first resistive ink containing a constituent for forming a resistor element to a base material by an ink jet method so as to dispose a plurality of first dots;

a second step of applying a second resistive ink by an ink jet method so as to dispose a plurality of second dots on the first dots to mix the first resistive ink of the first dots with the second resistive ink of the second dots, thus forming a mixed portion, the second resistive ink containing a constituent for forming the resistor element and having a different composition from that of the first resistive ink; and a third step of heating the mixed portion to yield the resistor element.

12. The method for manufacturing an electronic component according to claim 11, wherein the first step and the second step are performed at a temperature lower than or equal to room temperature.

* * * * *